US011374309B2

(12) United States Patent
Bisiules et al.

(10) Patent No.: US 11,374,309 B2
(45) Date of Patent: Jun. 28, 2022

(54) MULTI-BAND BASE STATION ANTENNAS HAVING RADOME EFFECT CANCELLATION FEATURES

(71) Applicant: CommScope Technologies LLC, Hickory, NC (US)

(72) Inventors: Peter J. Bisiules, LaGrange Park, IL (US); Mohammad Vatankhah Varnoosfaderani, Sydney (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/976,132

(22) PCT Filed: Jul. 2, 2019

(86) PCT No.: PCT/US2019/040227

§ 371 (c)(1),
(2) Date: Aug. 27, 2020

(87) PCT Pub. No.: WO2020/010039

PCT Pub. Date: Jan. 9, 2020

(65) Prior Publication Data

US 2020/0412011 A1 Dec. 31, 2020

Related U.S. Application Data

(60) Provisional application No. 62/829,171, filed on Apr. 4, 2019, provisional application No. 62/694,316, filed on Jul. 5, 2018.

(51) Int. Cl.
*H01Q 1/24* (2006.01)
*H01Q 5/50* (2015.01)
(Continued)

(52) U.S. Cl.
CPC ..... *H01Q 1/246* (2013.01); *H01Q 1/42* (2013.01); *H01Q 5/50* (2015.01); *H01Q 15/167* (2013.01);
(Continued)

(58) Field of Classification Search
CPC ..... H01Q 1/246; H01Q 1/42; H01Q 5/50; H01Q 15/165; H01Q 15/167; H01Q 19/10;
(Continued)

(56) References Cited

U.S. PATENT DOCUMENTS 5,724,052 A 3/1998 Boulingre et al.
9,257,743 B2 2/2016 Brady
(Continued)

FOREIGN PATENT DOCUMENTS

CN 106654596 A 5/2017
CN 206532886 U 9/2017
(Continued)

OTHER PUBLICATIONS

International Search Report and Written Opinion of the International Searching Authority, International Application No. PCT/US2019/040227, dated Oct. 25, 2019, 13 pp.
(Continued)

*Primary Examiner* — Robert Karacsony
(74) *Attorney, Agent, or Firm* — Myers Bigel, P.A.

(57) ABSTRACT

A base station antenna includes a radome and an antenna assembly that is mounted within the radome. The antenna assembly includes a backplane that includes a first reflector, a first array that includes a plurality of first radiating elements mounted to extend forwardly from the first reflector, a second reflector mounted to extend forwardly from the first reflector and a second array that includes a plurality of second radiating elements mounted to extend forwardly from the second reflector. The first radiating elements extend
(Continued)

a first distance forwardly from the first reflector and the second radiating elements extend a second distance forwardly from the second reflector, where the first distance exceeds the second distance.

22 Claims, 8 Drawing Sheets

(51) Int. Cl.

| | |
|---|---|
| ***H01Q 1/42*** | (2006.01) |
| ***H01Q 19/18*** | (2006.01) |
| ***H01Q 21/00*** | (2006.01) |
| ***H01Q 21/06*** | (2006.01) |
| ***H01Q 21/26*** | (2006.01) |
| ***H01Q 15/16*** | (2006.01) |
| ***H01Q 19/10*** | (2006.01) |

(52) U.S. Cl.
CPC ..... *H01Q 19/18* (2013.01); *H01Q 21/0025* (2013.01); *H01Q 21/062* (2013.01); *H01Q 21/26* (2013.01); *H01Q 19/108* (2013.01)

(58) Field of Classification Search
CPC .... H01Q 19/108; H01Q 19/18; H01Q 19/185; H01Q 21/0025; H01Q 21/062; H01Q 21/065; H01Q 21/26
See application file for complete search history.

(56) References Cited

U.S. PATENT DOCUMENTS

| | | | | |
|---|---|---|---|---|
| 2005/0046514 | A1 | 3/2005 | Janoschka | |
| 2006/0176235 | A1 | 8/2006 | Gottl et al. | |
| 2006/0192719 | A1 | 8/2006 | Kong et al. | |
| 2007/0241979 | A1 | 10/2007 | Yang | |
| 2009/0096700 | A1* | 4/2009 | Chair ..... | H01Q 21/26 343/797 |
| 2009/0305710 | A1 | 12/2009 | Johnson et al. | |
| 2010/0039346 | A1 | 2/2010 | Peter et al. | |
| 2010/0265150 | A1 | 10/2010 | Arvidsson et al. | |
| 2014/0168027 | A1 | 6/2014 | Katipally | |
| 2015/0280328 | A1 | 10/2015 | Sanford et al. | |
| 2017/0077587 | A1 | 3/2017 | Fleancu et al. | |

FOREIGN PATENT DOCUMENTS

| | | | |
|---|---|---|---|
| CN | 109659673 | A | 4/2019 |
| CN | 112490629 | A | 3/2021 |
| EP | 2472671 | A1 | 7/2012 |
| WO | 2007/002235 | A2 | 1/2007 |
| WO | 2015168845 | A1 | 11/2015 |

OTHER PUBLICATIONS

"Extended European Search Report for European Application No. 19831414.8, dated Mar. 24, 2022, 21 pages".

* cited by examiner

MULTI-BAND BASE STATION ANTENNAS HAVING RADOME EFFECT CANCELLATION FEATURES

CROSS-REFERENCE TO RELATED APPLICATIONS

The present application is a 35 U.S.C. § 371 national stage application of PCT Application No. PCT/US2019/040227, filed on Jul. 2, 2019, which itself is related to U.S. Provisional Patent Application Ser. No. 62/829,171, filed Apr. 4, 2019, and to U.S. Provisional Patent Application Ser. No. 62/694,316, filed Jul. 5, 2018, the entire content of each of which is incorporated herein by reference as if set forth fully herein.

BACKGROUND

The present invention generally relates to radio communications and, more particularly, to base station antennas for cellular communications systems.

Cellular communications systems are well known in the art. In a cellular communications system, a geographic area is divided into a series of regions or "cells" that are served by respective base stations. Each base station may include one or more base station antennas that are configured to provide two-way radio frequency ("RF") communications with subscribers that are within the cell served by the base station. In many cases, each base station is divided into "sectors." In one common configuration, a hexagonally-shaped cell is divided into three 120° sectors in the azimuth plane, and each sector is served by one or more base station antennas that have an azimuth Half Power Beamwidth (HPBW) of approximately 65°. Typically, the base station antennas are mounted on a tower or other raised structure, with the radiation patterns that are generated by the base station antennas directed outwardly. Base station antennas are often implemented as linear or planar phased arrays of radiating elements.

Conventionally, most cellular communications systems have operated in frequency bands that are at frequencies of less than 2.8 GHz. In order to accommodate the increasing volume of cellular communications, a variety of new frequency bands are being assigned for cellular communications service. Some of the new frequency bands that are being introduced for cellular communications service are within the 3-6 GHz frequency range. The use of these frequency bands, which may be nearly an order of magnitude higher in frequency than some of the existing cellular frequency bands, may result in new challenges in base station antenna design, particularly in multi-band antennas that include linear arrays of radiating elements that are designed to operate in different frequency bands.

SUMMARY

Pursuant to embodiments of the present invention, base station antennas are provided that include a radome and an antenna assembly that is mounted within the radome. The antenna assembly includes a backplane that includes a first reflector and a second reflector that is mounted to extend forwardly from the first reflector. A first array that includes a plurality of first radiating elements are mounted to extend forwardly from the first reflector, and a second array that includes a plurality of second radiating elements are mounted to extend forwardly from the second reflector. The first radiating elements extend a first distance forwardly from the first reflector and the second radiating elements extend a second distance forwardly from the second reflector, where the first distance exceeds the second distance.

In some embodiments, the second reflector may be electrically connected to the first reflector. The electrical connection may be a direct galvanic connection or a capacitive connection.

In some embodiments, the first radiating elements may be mounted to extend forwardly from a first planar surface of the first reflector and the second radiating elements may be mounted to extend forwardly from a second planar surface of the second reflector. The first planar surface may extend in parallel to the second planar surface in some embodiments, and/or the second reflector may include a pair of lips that extend in parallel to the second planar surface.

In some embodiments, each second radiating element may include at least one radiator, and the second radiating elements may be mounted so that a front surface of the radome is within a near field of the radiators of the second radiating elements.

In some embodiments, the base station antenna may further include a third array that includes a plurality of third radiating elements that are mounted to extend forwardly from the first reflector. The first and third radiating elements may be configured to operate in a first frequency band and the second radiating elements may be configured to operate in a second, higher, frequency band. In some embodiments, the second array may be positioned between the first array and the third array.

Pursuant to further embodiments of the present invention, base station antennas are provided that include a radome and an antenna assembly that is mounted within the radome. The antenna assembly includes a backplane having a stepped reflector that has at least a first front surface, a second front surface, and a sidewall disposed between the first front surface and the second front surface. The antenna assembly further includes a first array that has a plurality of first radiating elements that are mounted to extend forwardly from the first front surface and a second array that has a plurality of second radiating elements that are mounted to extend forwardly from the second front surface.

In some embodiments, the first front surface may be parallel to the second front surface.

In some embodiments, the second front surface may be closer to a front surface of the radome than is the first front surface. In such embodiments, the first radiating elements may be configured to operate in a first frequency band and the second radiating elements may be configured to operate in a second frequency band that is higher in frequency than the first frequency band.

In some embodiments, each second radiating element may include at least one radiator, and the second radiating elements may be mounted so that a front surface of the radome is within a near field of the radiators of the second radiating elements.

In some embodiments, the stepped reflector may further include a third front surface that is parallel to the second front surface and spaced apart from both the first front surface and the second front surface, and the base station antenna may further include a third array that has a plurality of third radiating elements that are mounted to extend forwardly from the third front surface.

In some embodiments, the stepped reflector may be a monolithic structure.

Pursuant to still further embodiments of the present invention, base station antennas are provided that include a radome and a backplane mounted within the radome. A linear array of radiating elements is mounted to extend forwardly from the backplane, each radiating element includes a feed stalk and a dipole radiator. Each radiator is mounted at a distance of approximately M*λ/4 forwardly of the backplane, where M is an odd integer greater than 1 and X is a wavelength corresponding to a center frequency of an operating frequency band of the dipole radiators. In some embodiments, M may be equal to 3, 5 or 7.

In some embodiments, each feed stalk may comprise a printed circuit board having a shielded transmission line thereon. The shielded transmission line may comprise, for example, a stripline transmission line or a coplanar waveguide transmission line.

In some embodiments, the radiating elements may be mounted so that a front surface of the radome is within a near field of the dipole radiators of the radiating elements.

In some embodiments, the linear array may be a first linear array of first radiating elements, and the base station antenna may further include a second linear array of second radiating elements that are configured to operate in a second frequency band. In such embodiments, dipole radiators of the second radiating elements may be mounted less than half a wavelength of a center frequency of the second operating frequency band forwardly from the backplane.

Pursuant to still further embodiments of the present invention, base station antennas are provided that include a radome and a reflector mounted within the radome. A linear array of radiating elements is mounted to extend forwardly from the reflector, where each radiating element includes a feed stalk and a dipole radiator. Each feed stalk has a length that is greater than λ/2, where λ is a wavelength corresponding to a center frequency of an operating frequency band of the dipole radiators.

DETAILED DESCRIPTION

Base station antennas typically include a radome that serves as at least part of an outer housing for the antenna. The radome may protect the interior components of the antenna from damage during shipping and installation, and from rain, ice, snow, moisture, wind, insects, birds, and other environmental factors once the base station antenna is installed for use. While base station antenna radomes may be formed of a variety of different materials, fiberglass radomes are the most common, as they are relatively lightweight, exhibit high mechanical strength and are reasonably inexpensive to manufacture.

Figure 8A:
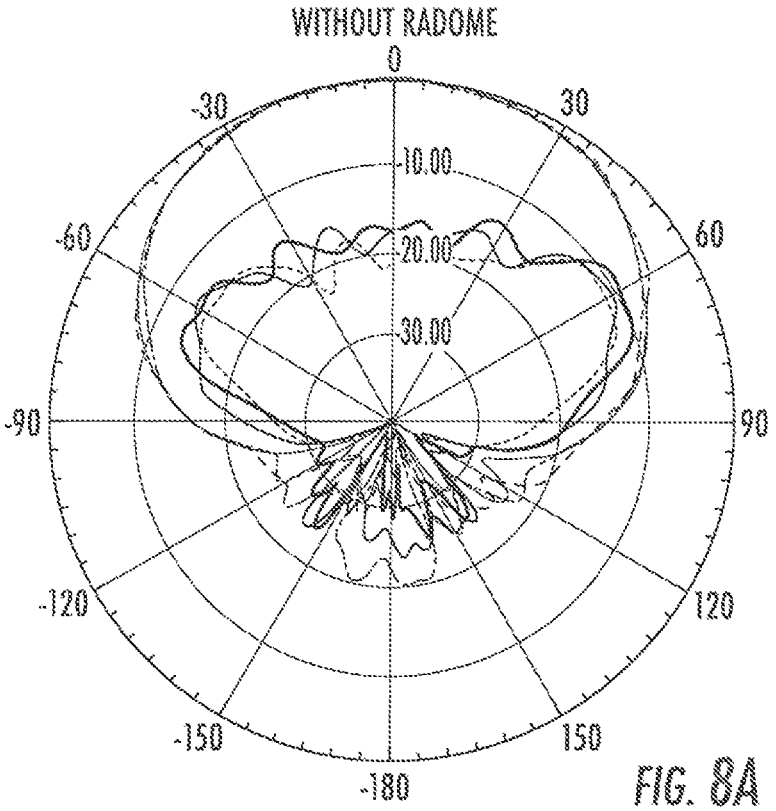
FIGS. 8A and 8B are azimuth radiation patterns that illustrate how a radome may impact the radiation pattern of a linear array of radiating elements.
Figure 8B:
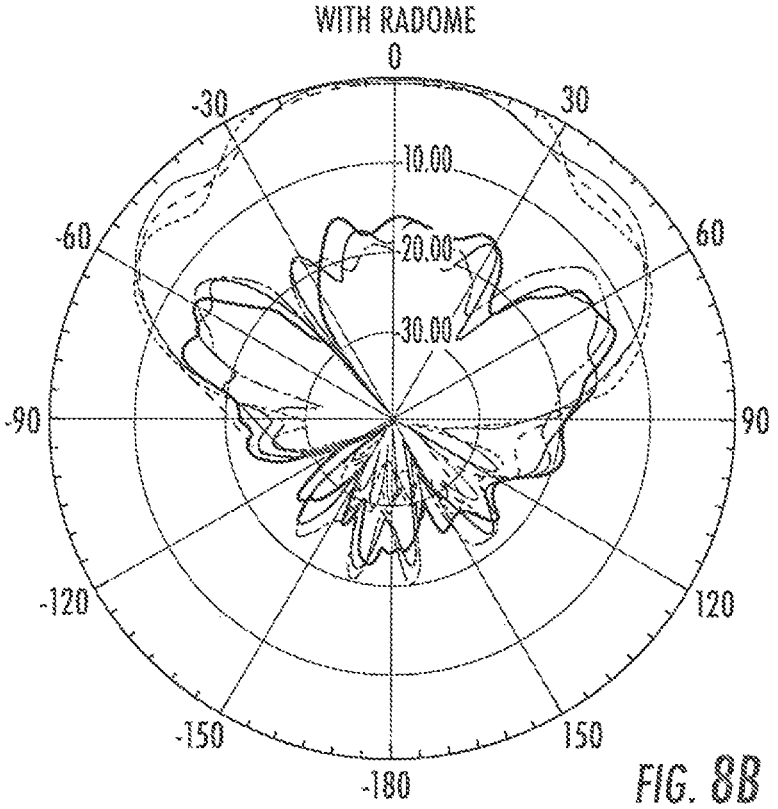

Unfortunately, the radome of a base station antenna can negatively impact the RF signals transmitted by the radiating elements of the base station antenna. For example, a radome may reflect some of the RF energy transmitted by the linear arrays of radiating elements of a base station antenna. Reflection of transmitted RF energy by a radome decreases the directivity, and hence gain, of the antenna, decreases the front-to-back ratio of the antenna (i.e., the ratio of forwardly directed radiation to rearwardly directed radiation, which preferably should be a large number) and may increase the return loss of the antenna. Moreover, since the impact of the radome is a function of the thickness of the radome along the direction of travel of the RF energy, the radome tends to have a greater impact on RF energy emitted at larger angles from the boresight pointing direction of the linear arrays, as at such angles the RF energy travels through more radome material. Consequently, the radome may also degrade the shapes of the radiation patterns generated by the respective linear arrays of radiating elements included in the antenna. FIGS. 8A and 8B are azimuth radiation patterns that illustrate how the above-described radome effects may impact the radiation pattern of a linear array of radiating elements, with FIG. 8A showing the radiation pattern before the radome is installed and FIG. 8B showing the radiation pattern after the radome is installed. The azimuth pattern shown in FIG. 8A has a suitable shape for a sector antenna. FIG. 8B shows how the addition of a radome may generally degrade the azimuth pattern.

The degree to which a radome will reflect RF signals tends to increase as the ratio of the thickness of the radome to the wavelength of the RF signal increases. Accordingly, the impact of a radome on the RF signals tends to increase as the thickness of the radome is increased and/or as the wavelength of the RF signal is reduced. As higher frequency RF signals have shorter wavelengths, the introduction of higher frequency bands for cellular communications service will tend to result in the radome reflecting an increased amount of RF energy.

Various techniques may be used to reduce or eliminate the above-described "radome effects" that can degrade the performance of a base station antenna. In one such technique, one or more dielectric layers (or structures) may be installed between the radiating elements of a linear array and the front surface of the radome at, for example, a quarter wavelength from the front surface of the radome. These dielectric structure(s) may partially cancel the reflections from the radome, reducing the negative radome effects. However, addition of the dielectric structures increases the cost of the antenna, and the dielectric structures will incur RF losses that reduce the gain of the radiation patterns. Another potential technique is to use radomes that are either thinner or are formed of lower dielectric constant materials (e.g., using PVC as opposed to fiberglass), as such radomes will have reduced impact on the RF signals. However, such changes may reduce the mechanical strength of the radome (and hence the amount of physical protection that the radome provides to the antenna), and/or may increase the cost of manufacturing the radome. As such, changes to the radome may not be a practical solution for many applications.

Pursuant to embodiments of the present invention, techniques are provided for reducing or eliminating the negative effects that a base station antenna may have on the radiation patterns generated by the linear arrays of radiating elements thereof. According to these techniques, the radiating elements included in linear arrays of radiating elements that would otherwise be impacted by the radome may be positioned so that the radome is within the near field of the radiating elements of these linear arrays. When the radome is in the near field, the radome appears to be part of the antenna structure and the reflections that might otherwise occur can be reduced or avoided altogether.

For single band base station antennas that only have a single type of radiating element, it may be relatively easy to design the antenna so that the radome is within the near field of the radiating elements, as the radome may be sized so that the front surface thereof is just forward of the radiating elements. However, in multi-band base station antennas, different sized radiating elements are typically used to support service in the different frequency bands, and hence the radome needs to be sized to accommodate the largest of the radiating elements (which typically are the radiating elements for the lowest frequency band). As a result, the radiating elements for the higher frequency bands tend to be farther removed from the radome. This may be problematic, as it is the higher frequency bands that are most susceptible to degradation by the radome, as discussed above.

Pursuant to some embodiments of the present invention, multi-band base station antennas having stepped backplanes are provided. The radiating elements included in the various arrays included in the antenna may be mounted to extend forwardly from the backplane, and the backplane may serve as both a reflector and as a ground plane for the radiating elements. The stepped backplane may have at least one protruding region that extends farther forwardly than the remainder of the backplane. Radiating elements that operate in a first frequency band may be mounted to extend forwardly from the protruding region of the backplane, while radiating elements that operate in a second, different frequency band may be mounted to extend forwardly from a different portion of the backplane. The protruding portion of the backplane may position the radiating elements that operate in a first frequency band close to the radome so that the radome is within the near field of the first frequency band radiating elements.

In other embodiments, multi-band base station antennas are provided that have both first and second reflectors. The second reflector may be mounted to extend forwardly from the first reflector, and the radiating elements that operate in a first frequency band are mounted to extend forwardly from the second reflector. Once again, this may position the radiating elements that operate in the first frequency band close to the radome so that the radome is within the near field of the radiating elements. The second reflector may be electrically coupled to the first reflector so that the second reflector will serve as a ground plane for the radiating elements that operate in a first frequency band. In some embodiments, the second reflector may be capacitively coupled to the first reflector in order to reduce or avoid the generation of passive intermodulation distortion that could occur as a result of any metal-on-metal connection between the first reflector and the second reflector.

In still other embodiments, the radiating elements that operate in the first frequency band may include feed stalks that extend a greater distance above the reflector than usual. As is known in the art, dipole radiators are typically mounted one quarter of a wavelength forwardly of a reflector so that rearwardly emitted RF radiation that reflects off the backplane will generally be in-phase with the forwardly directed radiation. So-called feed stalks are typically used to mount the dipoles a quarter wavelength in front of the reflector and to feed the RF signals to the dipoles. By extending the length of the feed stalks from one-quarter wavelength to three-quarters of a wavelength, the dipoles may be moved closer to the radome and the rearwardly emitted RF radiation that reflects off the reflector will still generally be in-phase with the forwardly directed radiation. Accordingly, pursuant to further embodiments of the present invention the feed stalks for selected radiating elements may be extended to 3/4, 5/4, 7/4, etc. of a wavelength in order to position the radiators of the radiating elements closer to the radome.

Embodiments of the present invention will now be discussed in greater detail with reference to the attached figures.

Figure 1:
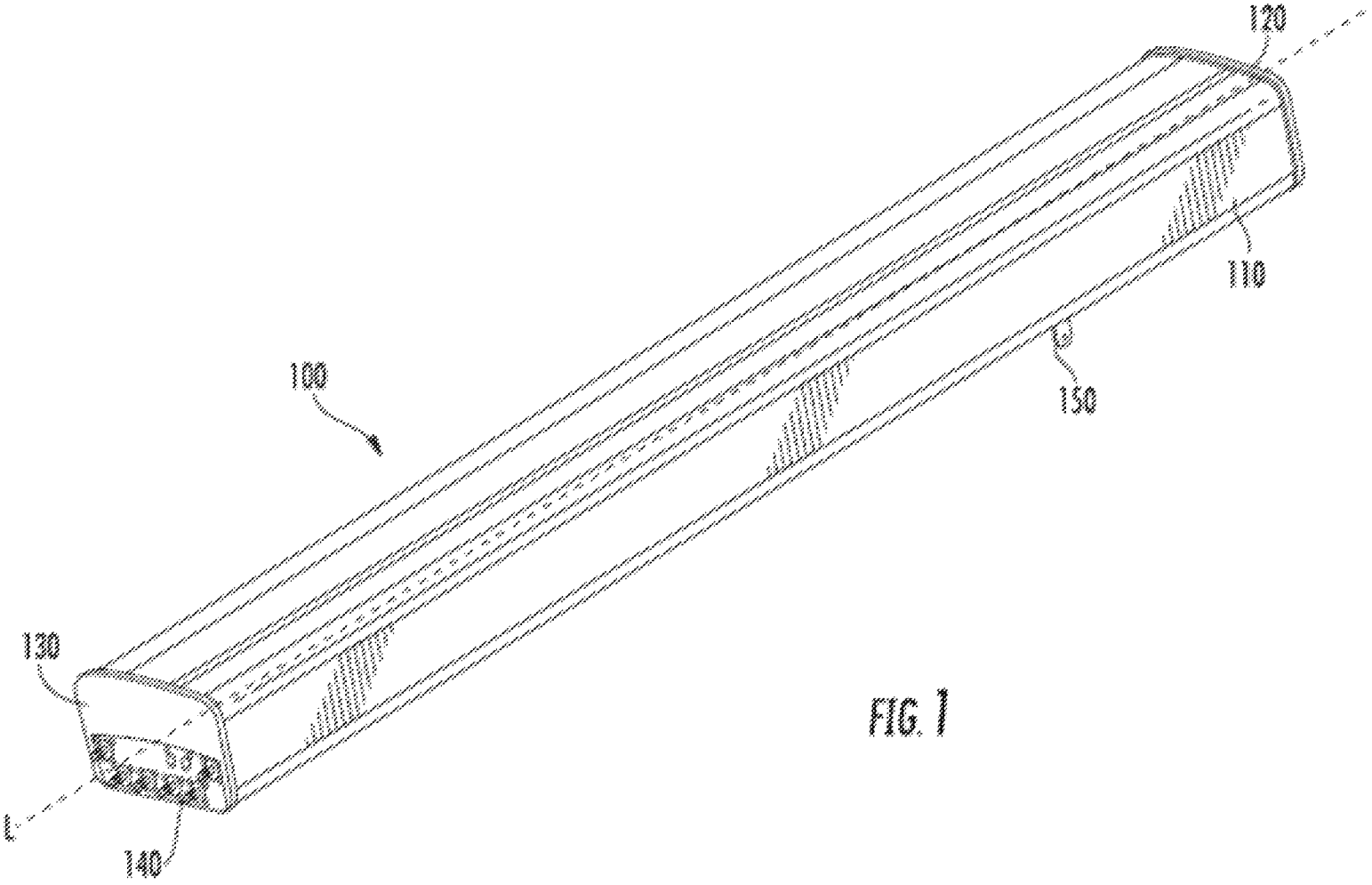
FIG. 1 is a perspective view of a base station antenna according to embodiments of the present invention.
Figure 2:
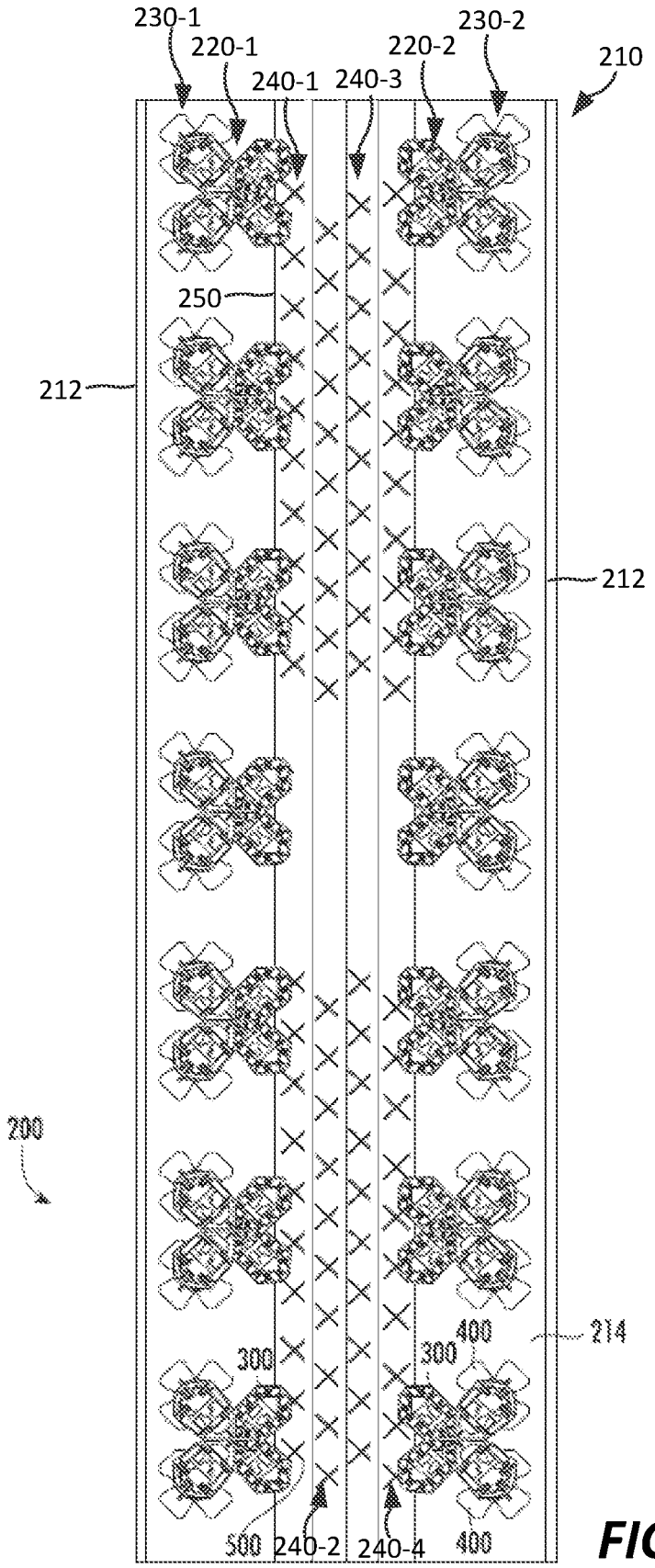
FIG. 2 is a front view of the base station antenna of FIG. 1 with the radome removed.
Figure 3:
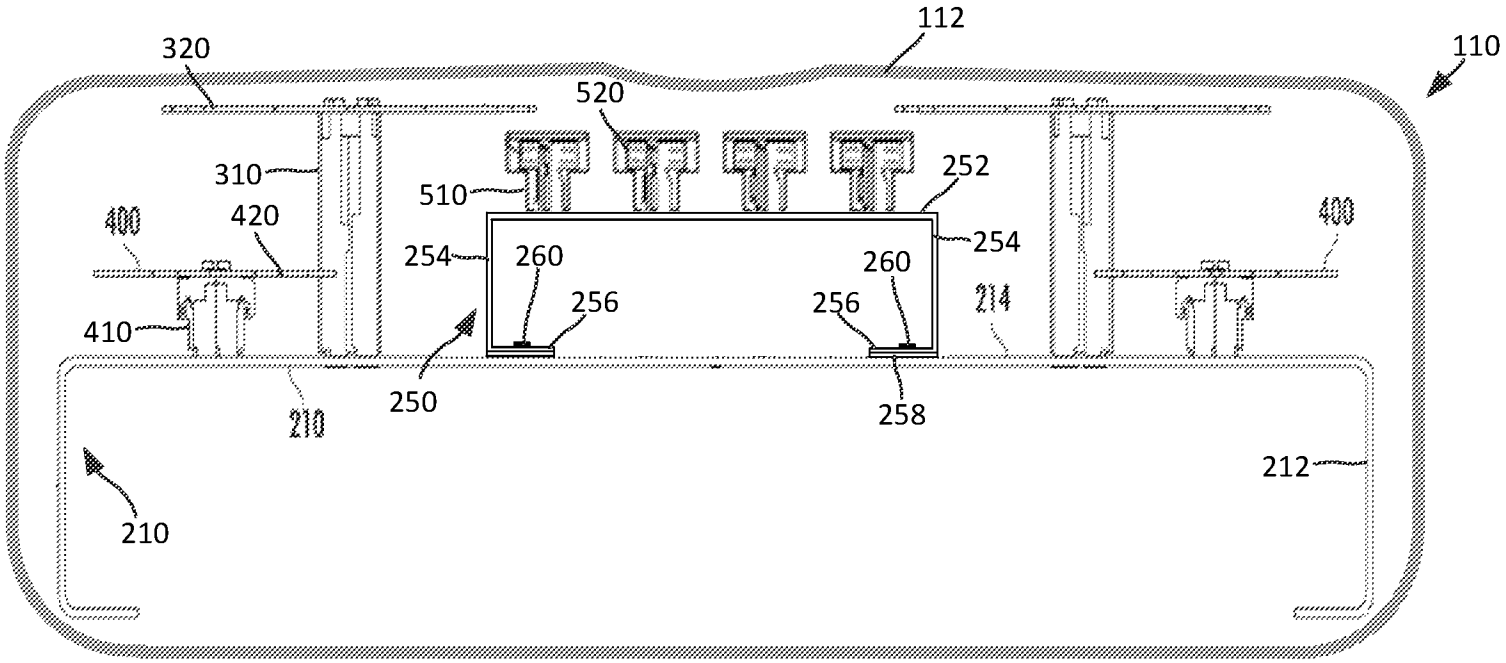
FIG. 3 is a cross-sectional view of the base station antenna of FIG. 1.
Figure 4:
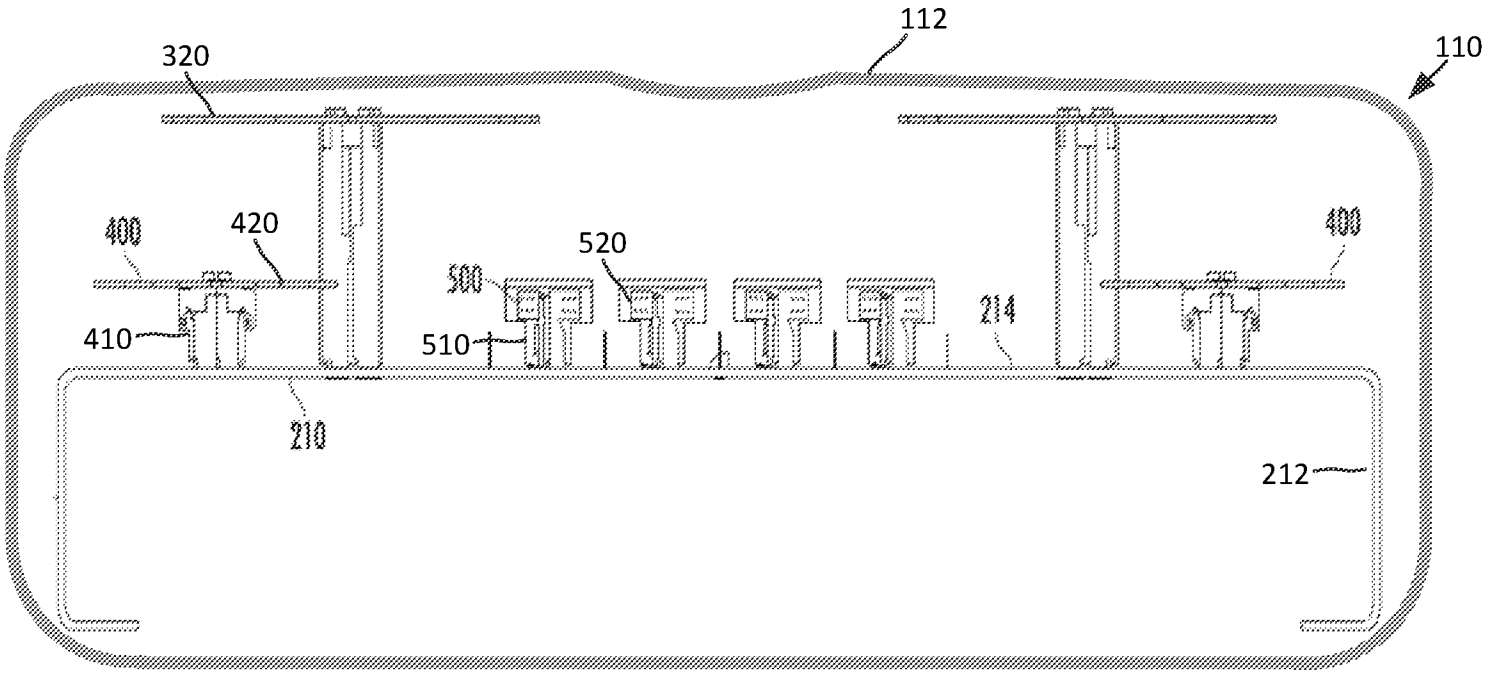
FIG. 4 is a cross-sectional view illustrating a conventional technique for mounting radiating elements in a base station antenna.

FIGS. 1-3 illustrate a base station antenna 100 according to certain embodiments of the present invention. In particular, FIG. 1 is a perspective view of the antenna 100, while FIG. 2 is a front view of the antenna 100 with the radome thereof removed to illustrate the antenna assembly 200 of the antenna 100, and FIG. 3 is a cross-sectional view of the antenna 100 with the radome in place. FIG. 4 is a cross-sectional view of a modified version of the antenna 100 that illustrates a conventional technique for mounting the radiating elements thereof.

In the description that follows, the antenna 100 will be described using terms that assume that the antenna 100 is mounted for normal use on a tower or other structure with the longitudinal axis of the antenna 100 extending along a vertical axis (i.e., generally perpendicular to a plane defined by the horizon) and the front surface of the antenna 100 mounted opposite the tower pointing toward the coverage area for the antenna 100.

As shown in FIG. 1, the base station antenna 100 is an elongated structure that extends along a longitudinal axis L. The base station antenna 100 may have a tubular shape with a generally rectangular cross-section. The antenna 100 includes a radome 110 and a top end cap 120. In some embodiments, the radome 110 and the top end cap 120 may comprise a single integral unit, which may be helpful for waterproofing the antenna 100. The radome 110 may serve as a housing that protects internal components of the antenna 100 from precipitation, moisture ingress, wind and the like. Preferably, the radome 110 is relatively rigid and mechanically strong to protect the internal components of the antenna during shipping and installation. One or more mounting brackets 150 are provided on the rear side of the antenna 100 which may be used to mount the antenna 100 onto an antenna mount (not shown) on, for example, an antenna tower. The antenna 100 also includes a bottom end cap 130 which includes a plurality of connectors 140 mounted therein.

As shown in FIG. 2, the antenna 100 includes an antenna assembly 200. The antenna assembly 200 may be slidably inserted into the radome 110 from either the top or bottom before the top cap 120 or bottom cap 130 are attached to the radome 110. The antenna assembly 200 includes a backplane 210 that has sidewalls 212 and a planar front surface 214 that acts as a reflector to reflect rearwardly emitted RF radiation in the forward direction. Herein, the front surface of backplane 210 is referred to as the first reflector 214. Various mechanical and electronic components of the antenna (not shown in the figures) may be mounted in the chamber defined between the sidewalls 212 and the back side of the reflector surface 214 such as, for example, phase shifters, remote electronic tilt units, mechanical linkages, a controller, diplexers, and the like. The first reflector 214 may comprise or include a metallic surface that serves as a reflector and ground plane for the radiating elements of the antenna 100.

A plurality of dual-polarized radiating elements 300, 400, 500 are mounted to extend forwardly from the first reflector 214. The radiating elements include low-band radiating elements 300, mid-band radiating elements 400 and high-band radiating elements 500. The low-band radiating elements 300 are mounted in two columns to form two linear arrays 220-1, 220-2 of low-band radiating elements 300. The low-band radiating elements 300 may be configured to transmit and receive signals in a first frequency band such as, for example, the 694-960 MHz frequency range or a portion thereof. The mid-band radiating elements 400 may likewise be mounted in two columns to form two linear arrays 230-1, 230-2 of mid-band radiating elements 400. The mid-band radiating elements 400 may be configured to transmit and receive signals in a second frequency band such as, for example, the 1427-2690 MHz frequency range or a portion thereof. The high-band radiating elements 500 are mounted in four columns to form four linear arrays 240-1 through 240-4 of high-band radiating elements 500. The high-band radiating elements 500 may be configured to transmit and receive signals in a third frequency band such as, for example, the 3300-4200 MHz frequency range or a portion thereof.

In the depicted embodiment, the linear arrays 240 of high-band radiating elements 500 are positioned between the linear arrays 220 of low-band radiating elements 300, and each linear array 220 of low-band radiating elements 300 is positioned between a respective one of the linear arrays 240 of high-band radiating elements 500 and a respective one of the linear arrays 230 of mid-band radiating elements 400. It will be appreciated that the arrangement of the linear arrays 220, 230, 240 may be varied from what is depicted in FIG. 2. Likewise, it will be appreciated that the number of linear arrays 220, 230, 240 may be varied from what is shown in FIG. 2, as may the number of radiating elements 300, 400, 500 per linear array 220, 230, 240, the type of radiating elements used, etc. Additionally, more or less different types of linear arrays may be included. For example, the linear arrays 230 of mid-band radiating elements 400 could be omitted in another example embodiment.

The low-band, mid-band and high-band radiating elements 300, 400, 500 may each be mounted to extend forwardly from the first reflector 214. The first reflector 214 may comprise a sheet of metal that, as noted above, serves as a reflector and as a ground plane for the radiating elements 300, 400, 500.

Each low-band, mid-band and high-band radiating element 300, 400, 500 may include a respective feed stalk 310, 410, 510 and one or more radiators 320, 420, 520 (see FIG. 3). In the depicted embodiment, each radiating element 300, 400, 500 is implemented as a cross-polarized dipole radiating element having feed stalks 310, 410, 510 that are formed using a pair of printed circuit boards that are configured in an "X" shape and a pair of dipole radiators 320, 420, 520 that are mounted forwardly from the backplane 210 by the feed stalks 310, 410, 510. For each radiating element 300, 400, 500, the first dipole radiator may be mounted at an angle of about −45° with respect to the horizon and the second dipole radiator may be mounted at an angle of about +45° with respect to the horizon so that each radiating element 300, 400, 500 may emit a first RF signal having a slant −45° polarization and a second RF signal having a slant +45° polarization.

Typically, the radiating elements of a multi-band antenna such as the antenna 100 are all mounted on a common backplane that has a generally planar reflector surface. FIG. 4 is a cross-sectional view of a modified version of the antenna 100 that illustrates this conventional mounting technique for comparative purposes. As shown in FIG. 4, the backplane 210 includes a planar first reflector 214 and a pair of side supports 212. The radiating elements 300, 400, 500 are all mounted to extend forwardly from the first reflector 214. The radome 110 may be designed to extend slightly farther forwardly than the low-band radiating elements 300. Since the high-band radiating elements 500 operate in a much higher frequency band, the feed stalks 510 on the high-band radiating elements 500 may be much shorter than the feed stalks 310 on the low-band radiating elements 300, and hence the dipole radiators 520 on the high-band radiating elements 500 may be positioned relatively far back from a front surface 112 of the radome 110.

As discussed above, a radome may start to reflect RF signals emitted by a radiating element that is mounted behind the radome as the ratio of the thickness of the radome to the wavelength of the RF signal increases. Various other factors, including the dielectric constant of the radome material and the distance separating the radiating element from the radome also impact the degree of reflection. It has been found that when low-band radiating elements 300 that operate in the 694-960 MHz frequency band and high-band radiating elements 500 that operate in the 3300-4200 MHz are mounted in the fashion shown in FIG. 4 behind a conventional fiberglass radome, the radiation patterns of the high-band radiating elements 500 are significantly distorted and significant reflections result in degradation of the antenna's front-to-back ratio and directivity (gain).

FIG. 3 is a cross-sectional view of the base station antenna 100 that illustrates a modified design that may significantly reduce or even eliminate the distortion that the radome 110 may have on the radiation patterns of the high-band radiating elements 500 pursuant to embodiments of the present invention. As shown in FIG. 3, a second reflector 250 is mounted to extend forwardly from a central portion of the first reflector 214. The second reflector 250 may comprise, for example, a piece of sheet metal that is bent to have the cross-section shown in FIG. 3. The second reflector 250 may have a front surface 252, sidewalls 254 and rear lips 256 which may extend either inwardly (as shown) or outwardly. The lips 256 may be used to mount the second reflector 250 to extend forwardly from the first reflector 214. Dielectric sheet material 258 may be interposed between the first reflector 214 and each lip 256 of the second reflector 250. Plastic screws or rivets 260 may be inserted through openings in the lips 256 and the first reflector 214 to secure the second reflector 250 to the first reflector 214. The use of plastic fasteners 260 along with the dielectric sheet material 258 interposed between the backplane 210 and each lip 256 of the second reflector 250 may advantageously avoid metal-to-metal contact between the first reflector 214 and the second reflector 250 that could give rise to passive intermodulation distortion. The second reflector 250 may be capacitively coupled to the first reflector 214 through the dielectric sheet material 258 to provide a ground reference to the second reflector 250.

As shown in FIG. 3, the high-band radiating elements 500 are mounted to extend forwardly from the second reflector 250. The sidewalls 254 of the second reflector 250 may be dimensioned so that the distance between the first reflector 214 and the front surface 252 of the second reflector 250 may be selected so that the radiators 520 of the high-band radiating elements 500 may be located in close proximity to the front surface 112 of the radome 110. The radome 110 may thus be in the near field of the radiating elements 500. When positioned in the near field, the radome 110 may appear to be part of the radiating element 500 and reflection of RF energy emitted by the radiating element 500 may be reduced or even largely eliminated.

It has been found that mounting the second reflector 250 to extend forwardly from the first reflector 214 may not only reduce the radome effect, but may also improve other performance aspects of the base station antenna 100. For example, in an antenna such as base station antenna 100 that includes eight linear arrays of radiating elements, it is typically necessary to space the linear arrays in very close proximity to one another. This may result in coupling between different ones of the linear arrays that may degrade the radiation patterns. In the base station antenna 100, such coupling is of particular concern with respect to the linear arrays 220-1 and 220-2 (i.e., the two linear arrays of low-band radiating elements). It has been found that the inclusion of the second reflector 250, as well as the fact that the radiating elements 500 are mounted farther forwardly, tends to act as an RF shield structure that reduces coupling between linear arrays 220-1 and 220-2, and thus the inclusion of the second reflector 250 may actually improve the radiation patterns of linear arrays 220-1, 220-2.

Figure 5:
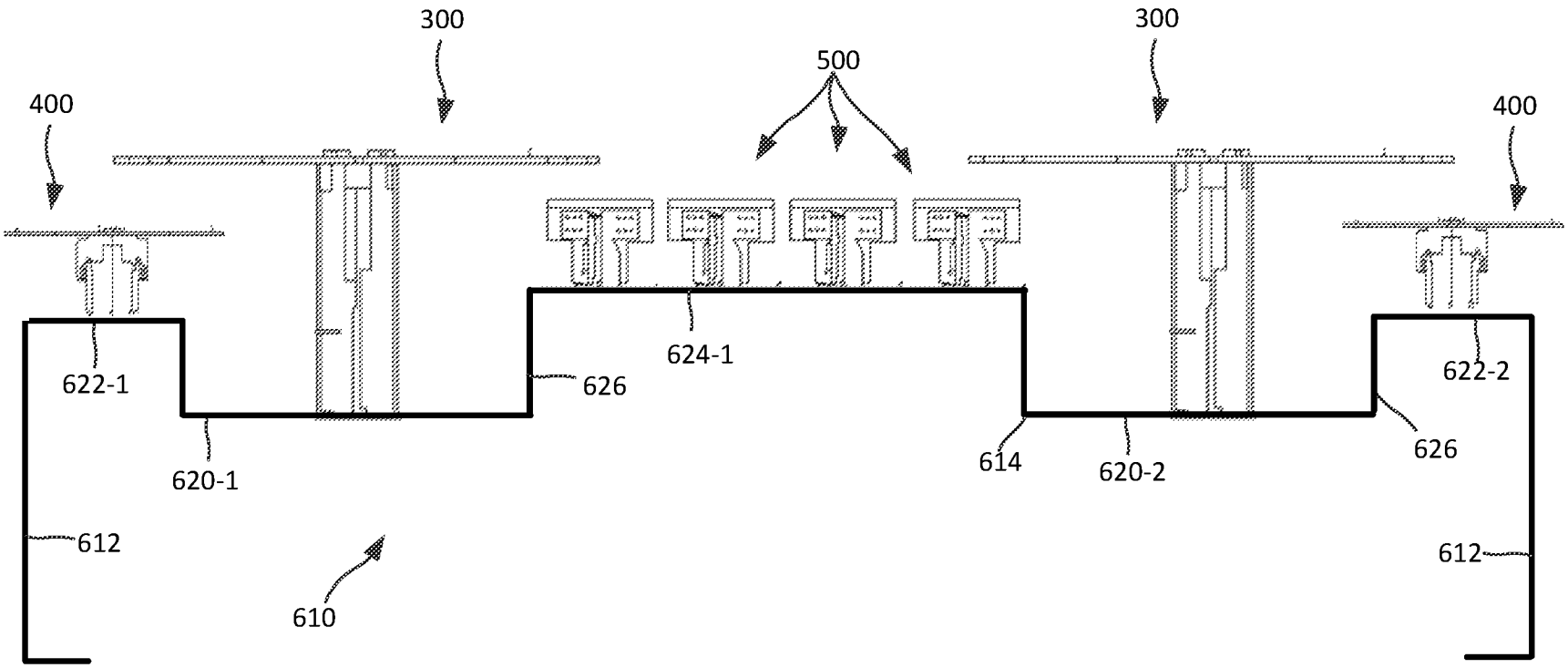
FIG. 5 is a schematic cross-sectional diagram illustrating a backplane having a stepped reflector that may be used in place of the backplane and secondary reflector included in the base station antenna of FIGS. 1-3.

FIG. 5 is a schematic diagram illustrating a backplane 610 that may be used in place of the backplane 210 and second reflector 250 illustrated in FIG. 3. As shown in FIG. 5, the backplane 610 includes side supports 612 and a stepped reflector 614. The stepped reflector 614 may include low-band steps 620 that serve as mounting surfaces for the low-band radiating elements 300, mid-band steps 622 that serve as mounting surfaces for the mid-band radiating elements 400, and a high-band step 624 that serves as a mounting surface for the high-band radiating elements 500. The low-band steps 620 may be the farthest from the front surface 112 of the radome 110, the high-band steps 624 may be the closest to the front surface 112 of the radome 110, and the mid-band steps 622 may be at an intermediate position between the low-band steps 622 and the high-band steps 624. The steps 620, 622, 624 may be connected by sidewalls 626. The backplane 610 may be formed by bending a unitary piece of sheet metal, and may be used to advantageously position the radiators of all of the radiating elements 300, 400, 500 in close proximity to the front surface 112 of the radome 110.

Figure 6A:
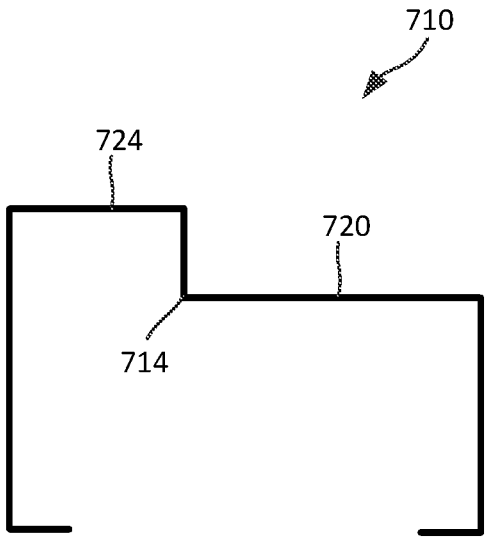
FIGS. 6A and 6B are schematic cross-sectional diagrams illustrating additional backplane designs that have stepped reflectors according to embodiments of the present invention.
Figure 6B:
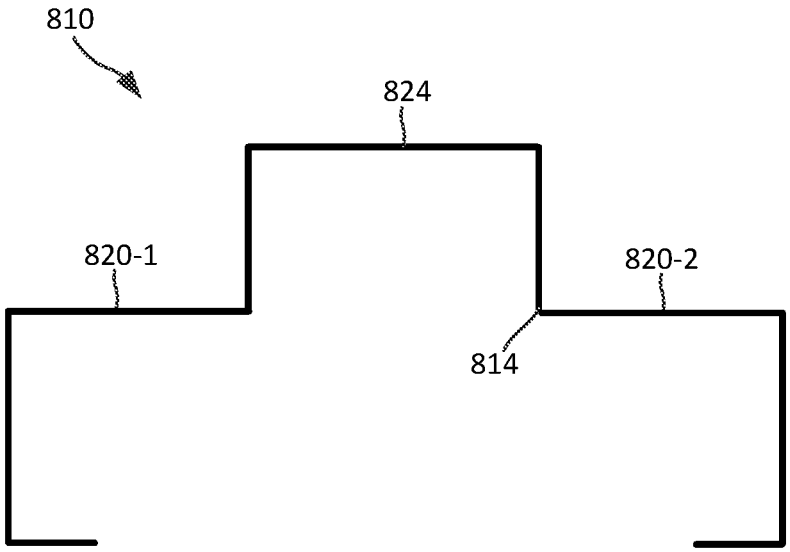

It will be appreciated that the backplane 610 having the stepped reflector 614 of FIG. 5 represents one example backplane design, and that the same concept may be used to provide stepped reflectors for a wide variety of different base station antennas. The number and locations of the stepped surfaces may depend, for example, on the different types and locations of the linear arrays of radiating elements included in a particular base station antenna as well as the extent to which the radiating elements are impacted by the radome. By way of example, FIGS. 6A and 6B illustrate two additional backplanes that have stepped reflectors. Referring first to FIG. 6A, a backplane 710 is illustrated that has a stepped reflector 714 that has a low-band step 720 that serves as a mounting surface for a linear array of low-band radiating elements (not shown) and a high-band step 724 that serves as a mounting surface for a linear array of high-band radiating elements (not shown). FIG. 6B schematically illustrates a backplane 810 that has a stepped reflector 814 that has a pair of low-band steps 820 that serve as mounting surfaces for a respective pair of linear arrays of low-band radiating elements (not shown) and a high-band step 824 that serves as a mounting surface for one or more linear arrays of high-band radiating elements (not shown).

Figure 7:
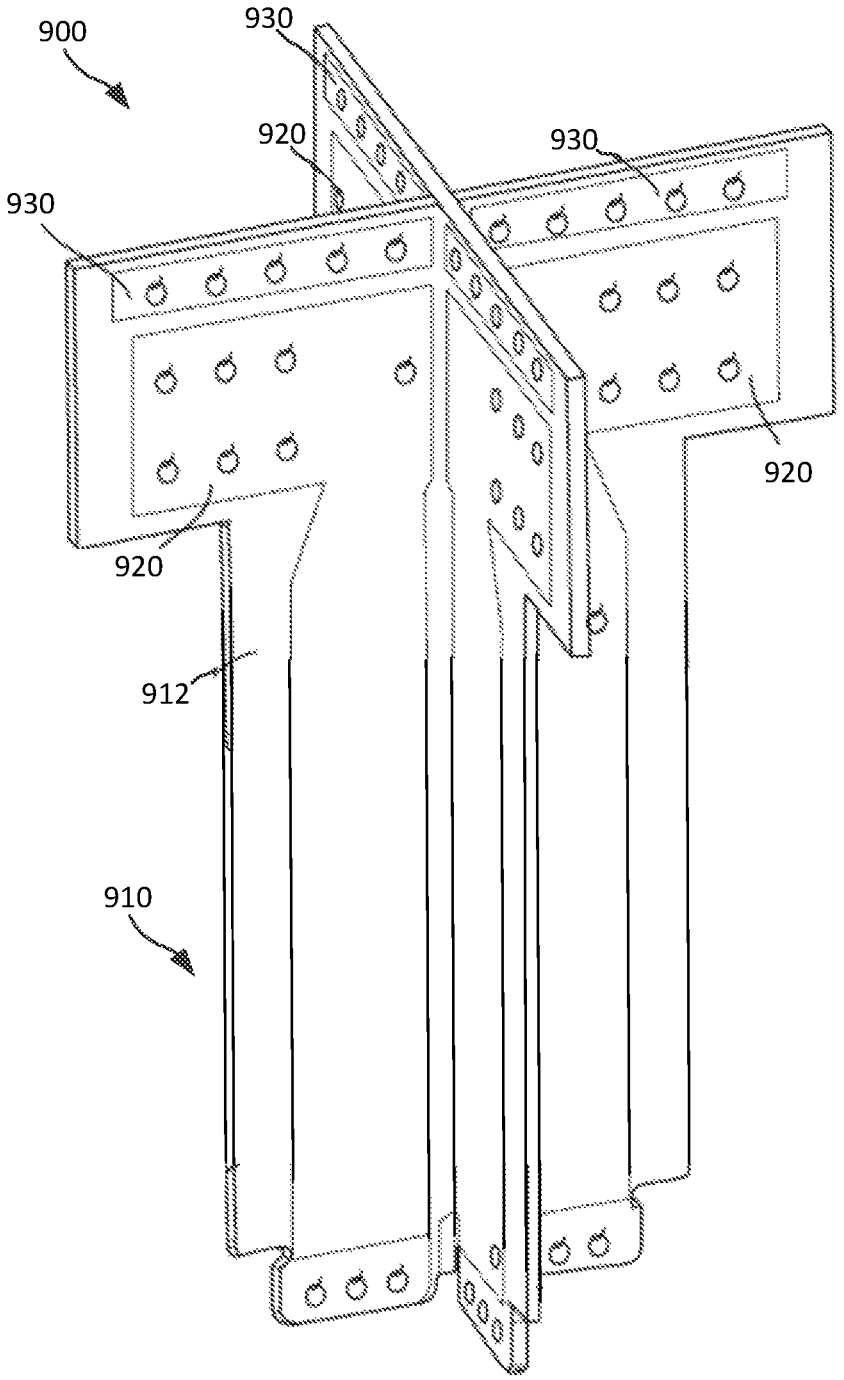
FIG. 7 is a schematic perspective view of a radiating element according to embodiments of the present invention that has an extended feed stalk.

Pursuant to further embodiments of the present invention, the radiators of the high-band radiating elements may be positioned in close proximity to the front surface 112 of the radome 110 by designing the high-band radiating elements to have extended feed stalks. A high-band radiating element 900 having such a design is schematically shown in FIG. 7. The high-band radiating element 900 is designed to operate in two separate frequency bands, namely the 3.3-4.2 GHz and 5.1-5.3 GHz frequency bands.

As shown in FIG. 7, the radiating element 900 is a cross-polarized radiating element having a feed stalk 910 that is implemented as a pair of printed circuit boards 912 that are arranged in an "X" configuration, a pair of dipole radiators 920, and a pair of dipole radiators 930. The dipole radiators 920 are configured to operate in, for example, the 3.3-3.8 GHz frequency band, and are directly driven by feed lines included in the respective printed circuit boards 912. The two dipole radiators 920 are arranged orthogonally to each other at angles of −45° and +45° with respect to the longitudinal (vertical) axis of the antenna so that the dipole radiators will emit RF signals having slant −45° and slant +45° polarizations, respectively.

The dipole radiators 930 are configured to operate in, for example, the 5.1-5.3 GHz frequency band. The dipole radiators 930 are located forwardly of the dipole radiators 920. When a 3.5 GHz signal is input to the radiating element 900, it is fed directly to one of the dipole radiators 920. When a 5.1 GHz signal is input to the radiating element 900, the energy electromagnetically couples to one of the 5.1 GHz parasitic dipole radiators 930, which then resonates at 5.1 GHz. The two dipole radiators 930 are also arranged orthogonally to each other at angles of −45° and +45° with respect to the longitudinal (vertical) axis of the antenna so that the dipole radiators 930 will emit RF signals having slant −45° and slant +45° polarizations, respectively.

The feed stalks 910 may have a height so that the dipole radiators 920 are mounted forwardly of a reflector at a distance of about ¾ of a wavelength of the center frequency of the operating frequency band of the dipole radiators 920. This approach acts to mount the dipole radiators 920 further from an underlying reflector, and hence closer to the front surface 112 of the radome 110. As described above, if the dipole radiators 920, 930 are mounted so that the radome 110 is in the near field of the dipole radiators 920, 930, then the radome may appear as part of the radiating element 900, which will reduce or eliminate any tendency for the radome 110 to reflect RF energy that is transmitted by the radiating element 900. While in the embodiment of FIG. 7, the dipole radiators 920, 930 are mounted at a distance of about ¾ of a wavelength (λ) in front of the reflector, it will be appreciated that in other embodiments the dipole radiators 920, 930 could be mounted at a distance of $M*\lambda/4$, where M is an odd integer greater than 1. In still other embodiments, the distance may be greater than $\lambda/2$.

The printed circuit boards 912 that are used to implement the feed stalks 910 may include shielded RF transmission lines that are used to pass RF signals between the dipole radiators 920 and other components of an antenna that includes the radiating elements 900. Thus, it will be understood that the printed circuit boards 912 may comprise stripline printed circuit boards or may use coplanar waveguide transmission lines or other shielded transmission line structures.

While the example embodiments of the present invention have focused primarily on modification to the backplane and/or radiating element design for radiating elements that operate in some or all of the 3.3-4.2 GHz frequency range, it will be appreciated that the techniques disclosed herein may be used with any appropriate frequency band. For example, in other embodiments, the techniques disclosed herein may be used to improve the performance of linear arrays of radiating elements that operate in the 1.7-2.7 GHz frequency band or portions thereof.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

In the description above, like elements are referred to individually by their full reference numeral (e.g., linear array 230-2) and are referred to collectively by the first part of their reference numeral (e.g., the linear arrays 230).

In the discussion above, reference is made to the linear arrays of radiating elements that are commonly included in base station antennas. It will be appreciated that herein the term "linear array" is used broadly to encompass both arrays of radiating elements that include a single column of radiating elements that are configured to transmit the sub-components of an RF signal as well as to two-dimensional arrays of radiating elements (i.e., multiple linear arrays) that are configured to transmit the sub-components of an RF signal. It will also be appreciated that in some cases the radiating elements may not be disposed along a single line. For example, in some cases a linear array of radiating elements may include one or more radiating elements that are offset from a line along which the remainder of the radiating elements are aligned. This "staggering" of the radiating elements may be done to design the array to have a desired azimuth beamwidth. Such staggered arrays of radiating elements that are configured to transmit the sub-components of an RF signal are encompassed by the term "linear array" as used herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

a radome; and an antenna assembly that is mounted within the radome, the antenna assembly including:

a backplane that includes a first reflector;

a first array that includes a plurality of first radiating elements that are mounted to extend forwardly from the first reflector;

a second reflector that is positioned forwardly of a plane defined by the first reflector; and a second array that includes a plurality of second radiating elements that are mounted to extend forwardly from the second reflector, wherein the first radiating elements extend a first distance forwardly from the first reflector and the second radiating elements extend a second distance forwardly from the second reflector, where the first distance exceeds the second distance, wherein the second reflector is electrically connected to the first reflector, and the second reflector is capacitively coupled to the first reflector.

2. The base station antenna of claim 1, wherein the first radiating elements are mounted to extend forwardly from a first planar surface of the first reflector and the second radiating elements are mounted to extend forwardly from a second planar surface of the second reflector.

3. The base station antenna of claim 2, wherein the first planar surface extends in parallel to the second planar surface.

4. The base station antenna of claim 2, wherein the second reflector includes a pair of lips that extend in parallel to the second planar surface.

5. The base station antenna of claim 1, wherein each second radiating element includes at least one radiator, and wherein the second radiating elements are mounted so that a front surface of the radome is within a near field of each radiator the radiators of the second radiating elements.

6. The base station antenna claim 1, wherein the second reflector is supported by the first reflector.

7. A base station antenna, comprising:

a radome; and an antenna assembly that is mounted within the radome, the antenna assembly including:

a backplane that includes a stepped reflector that has at least a first front surface, a second front surface, a third front surface, a first sidewall disposed between the first front surface and the second front surface and a second sidewall disposed between the second front surface and the third front surface;

a first array that includes a plurality of first radiating elements that are mounted to extend forwardly from the first front surface;

a second array that includes a plurality of second radiating elements that are mounted to extend forwardly from the second front surface, a third array that includes a plurality of first radiating elements that are mounted to extend forwardly from the third front surface;

wherein the stepped reflector comprises a monolithic piece of sheet metal that is bent to form the first through third front surfaces and the first and second sidewalls, wherein the first radiating elements are configured to operate in a first frequency band and the second radiating elements are configured to operate in a second frequency band that is higher in frequency than the first frequency band, wherein the second array is positioned between the first array and the third array, wherein the second array includes four columns of second radiating elements, and wherein the second front surface is a farthest forwardly extending portion of the stepped reflector.

8. The base station antenna of claim 7, wherein each second radiating element includes at least one radiator, and wherein the second radiating elements are mounted so that a front surface of the radome is within a near field of each radiator of the second radiating elements.

9. A base station antenna, comprising:

a radome; and an antenna assembly that is mounted within the radome, the antenna assembly including:

a backplane that includes a first reflector;

a first array that includes a plurality of first radiating elements that are mounted to extend forwardly from the first reflector;

a second reflector that is positioned forwardly of a plane defined by the first reflector;

a second array that includes a plurality of second radiating elements that are mounted to extend forwardly from the second reflector; and a third array that includes a plurality of third radiating elements that are mounted to extend forwardly from the first reflector, the first radiating elements configured to operate in a first frequency band and the second radiating elements configured to operate in a second, higher, frequency band, wherein the first radiating elements extend a first distance forwardly from the first reflector and the second radiating elements extend a second distance forwardly from the second reflector, where the first distance exceeds the second distance.

10. The base station antenna claim 9, wherein the second array is positioned between the first array and the third array.

11. A base station antenna, comprising:

a radome; and an antenna assembly that is mounted within the radome, the antenna assembly including:

a backplane that includes a first reflector;

a first array that includes a plurality of first radiating elements that are mounted to extend forwardly from the first reflector;

a second reflector that is separate from the first reflector and mounted to extend forwardly of the first reflector; and a second array that includes a plurality of second radiating elements that are mounted to extend forwardly from the second reflector, wherein a front surface of the second reflector is positioned forwardly of a front surface of the first reflector, wherein the first radiating elements extend a first distance forwardly from the first reflector and the second radiating elements extend a second distance forwardly from the second reflector, where the first distance exceeds the second distance.

12. The base station antenna of claim 11, wherein the front surface of the second reflector is closer to a front surface of the radome than is the front surface of the first reflector.

13. The base station antenna of claim 12, wherein the second radiating elements are mounted so that a front surface of the radome is within a near field of each radiator of the second radiating elements.

14. The base station antenna of claim 13, wherein the front surface of the first reflector extends in parallel to the front surface of the second reflector.

15. The base station antenna of claim 11, wherein the second reflector is electrically connected to the first reflector.

16. The base station antenna of claim 11, wherein a portion of the first reflector is behind the second reflector so that an axis that is perpendicular to the front surface of the second reflector intersects the front surface of the first reflector.

17. The base station antenna of claim 11, wherein the second reflector includes at least one outwardly extending lip.

18. The base station antenna of claim 11, wherein the first radiating elements are configured to operate in at least a portion of the 694-960 MHz frequency band, and the second radiating elements are configured to operate in at least a portion of the 3300-4200 MHz frequency band.

19. A base station antenna, comprising:

a radome; and an antenna assembly that is mounted within the radome, the antenna assembly including:

a first reflector;

a second reflector that is closer to a front surface of the radome than is the first reflector;

a lower frequency band radiating element that is mounted to extend forwardly from the first reflector; and a higher frequency band radiating element that is mounted to extend forwardly from a second reflector, wherein the higher frequency band radiating element is mounted so that a front surface of the radome is within a near field of a radiator of the higher frequency band radiating element.

20. The base station antenna of claim 19, wherein a portion of the first reflector is behind the second reflector so that an axis that is perpendicular to a front surface of the second reflector intersects a front surface of the first reflector.

21. The base station antenna of claim 19, wherein the lower frequency band radiating element is part of an array of lower frequency band radiating elements that are mounted to extend forwardly from the first reflector, where each lower frequency band radiating element is configured to operate in at least a portion of the 694-960 MHz frequency band, and the higher frequency band radiating element is part of an array of higher frequency band radiating elements that are mounted to extend forwardly from the second reflector, where each higher frequency band radiating element is configured to operate in at least a portion of the 3300-4200 MHz frequency band.

22. The base station antenna of claim 19, wherein the second reflector includes at least one outwardly extending lip.

* * * * *